US005133368A

United States Patent [19]

Neumann et al.

[11] Patent Number: 5,133,368

[45] Date of Patent: Jul. 28, 1992

[54] IMPACT MODIFYING AGENT FOR USE WITH SMOKING ARTICLES

[75] Inventors: Calvin L. Neumann, Winston-Salem; William J. Casey, III, Clemmons, both of N.C.

[73] Assignee: R. J. Reynolds Tobacco Company, Winston-Salem, N.C.

[21] Appl. No.: 131,348

[22] Filed: Dec. 9, 1987

Related U.S. Application Data

[63] Continuation of Ser. No. 940,818, Dec. 12, 1986, abandoned.

[51] Int. Cl.[5] ..... A24D 1/02; A24D 1/18

[52] U.S. Cl. ..... 131/335; 131/276; 131/359

[58] Field of Search ..... 131/276, 359, 365, 339

[56] References Cited

U.S. PATENT DOCUMENTS

| | | |
|---|---|---|
| Re. 27,214 | 11/1971 | Nakahara . |
| 2,907,686 | 10/1959 | Siegel . |
| 3,136,319 | 6/1964 | Jarobe . |
| 3,258,015 | 6/1966 | Ellis et al. . |
| 3,356,094 | 12/1957 | Ellis et al. . |
| 3,516,417 | 6/1970 | Moses . |
| 3,878,850 | 4/1975 | Gibson et al. . |
| 3,924,642 | 12/1975 | Eicher et al. . |
| 3,924,644 | 12/1975 | Anderson et al. . |
| 3,943,941 | 3/1976 | Boyd et al. . |
| 4,044,777 | 8/1977 | Boyd et al. . |
| 4,079,742 | 3/1978 | Rainer et al. . |
| 4,125,118 | 11/1978 | Rudner . |
| 4,256,126 | 3/1981 | Seligman et al. . |
| 4,284,089 | 8/1981 | Ray . |
| 4,286,604 | 9/1981 | Ehretsmann et al. . |
| 4,326,544 | 4/1982 | Hardwick et al. . |
| 4,340,072 | 7/1982 | Bolt et al. . |
| 4,391,285 | 7/1983 | Burnett . |
| 4,474,191 | 10/1984 | Steiner . |

FOREIGN PATENT DOCUMENTS

| | | |
|---|---|---|
| 117355 | 9/1984 | European Pat. Off. . |
| 174645 | 3/1986 | European Pat. Off. . |
| 1398538 | 9/1985 | Liberia . |

OTHER PUBLICATIONS

Sensabaugh et al., Tobacco Science 11:25-30 (1967).
Tobacco Substitutes, Noyes Data (1976).
Ames et al., Mut. Res., 31:347-364 (1975).
Wagao et al., Mt. Res. 42:335 (1977).
Steffen Arctander, Perfume and Flavor Chemicals, Montclair, N.J., 1969.
Leffingwell et al., Tobacco Flavoring for Smoking Products Winston-Salem, N.C. 1972.

*Primary Examiner*—V. Millin
*Attorney, Agent, or Firm*—Grover M. Myers; David G. Conlin

[57] ABSTRACT

The present invention preferably relates to the use of an impact modifying agent and in particular the use of levulinic acid, a carbohydrate ester acetate or a carbohydrate ester levulinate in one or more of the component parts of a smoking article comprising a carbonaceous fuel element and a physically separate non-burning charge of tobacco or tobacco extract which article is capable of producing substantial quantities of aerosol, both initially and over the useful life of the product, without significant thermal degradation of the aerosol former and without the presence of substantial pyrolysis or incomplete combustion products or sidestream aerosol. The use of an impact modifying agent in smoking articles in accordance with the present invention provides the user with the sensations and benefits of cigarette smoking without burning tobacco and without the undesirable impact or off-taste commonly found in previous smoking articles.

15 Claims, 1 Drawing Sheet

IMPACT MODIFYING AGENT FOR USE WITH SMOKING ARTICLES

BACKGROUND OF THE INVENTION

The present invention relates to the use of impact modifying agents in smoking articles which articles preferably produce an aerosol that resembles tobacco smoke and which preferably contain no more than a minimal amount of incomplete combustion or pyrolysis products. More specifically, the invention relates to impact modifying agents for inclusion in the aerosol generating means of such smoking articles in order to improve the palatability of the aerosol produced during smoking by modulating the impact of the aerosol, e.g. by controlling the degree of harshness perceived by the user as irritation and impact in the mouth, nose and throat of the user.

Cigarette-like smoking articles have been proposed for many years, especially during the last 20 to 30 years. See for example, U.S. Pat. No., 4,079,742 to Rainer et al; U.S. Pat. No. 4,284,089 to Ray; U.S. Pat. No. 2,907,686 to Siegel; U.S. Pat. Nos. 3,258,015 and 3,356,094 to Ellis et al.; U.S. Pat. No. 3,516,417 to Moses; U.S. Pat. Nos. 3,943,941 and 4,044,777 to Boyd et al.; U.S. Pat. No. 4,286,604 to Ehretsmann et al.; U.S. Pat. No. 4,326,544 to Hardwick et al.; U.S. Pat. No. 4,340,072 to Bolt et al.; U.S. Pat. No. 4,391,285 to Burnett; U.S. Pat. No. 4,474,191 to Steiner; and European Patent Appln. No. 117,355 (Hearn).

As far as the present inventors are aware, none of the foregoing smoking articles or tobacco substitutes have ever realized any commercial success and none have ever been widely marketed. The absence of such smoking articles from the marketplace is believed to be due to a variety of reasons, including insufficient aerosol generation, both initially and over the life of the product, poor taste, off-taste due to thermal degradation of the smoke former and/or flavor agents, the presence of substantial pyrolysis products and sidestream smoke, and unsightly appearance.

Thus, despite decades of interest and effort, there is still no smoking article on the market which provides the benefits and advantages associated with conventional cigarette smoking, without delivering considerable quantities of incomplete combustion and pyrolysis products.

In late 1985, a series of foreign patents were granted or registered disclosing novel smoking articles capable of providing the benefits and advantages associated with conventional cigarette smoking, without delivering appreciable quantities of incomplete combustion or pyrolysis products. The earliest of these patents was Liberian Patent No. 13985/3890, issued 13 Sep. 1985. This patent corresponds to a later published European Patent Application, Publication No. 174,645, published 19 Mar. 1986.

In an effort to improve the palatability of the aerosol produced by smoking articles of the type described in the foregoing foreign patents, numerous additives including many of those described in Gibson et al., U.S. Pat. No. 3,878,850 were evaluated. Virtually all of these additive materials suffered from one or more disadvantages. For instance, many of these additives, particularly the low molecular weight additives, tended to evaporate or migrate away from the smoking article. Such additives were ineffective in reducing the harshness of the aerosol produced, particularly if any shelf life is required of the smoking article. Many other additives had an unpleasant taste or odor.

SUMMARY OF THE INVENTION

The present invention relates to impact modifying agents for smoking articles and more specifically to smoking articles utilizing such impact modifying agents. In particular, the present invention relates to the use of impact modifying agents such as carbohydrate ester acetates, levulinic acid and carbohydrate ester levulinates and preferably levulinic acid and/or glucose pentaacetate in smoking articles. Such impact modifying agents modulate the impact of the aerosol by controlling the degree of harshness of the aerosol produced by such articles, e.g. by reducing the irritation and impact in the mouth, nose and throat, without the production of undesirable side products such as aldehydes, ketones and carbon monoxide. In addition, there is a reduction in migration of the impact modifying agent which improves the shelf life of smoking articles employing the same. Preferred smoking articles employing impact modifying agents in accordance with the present invention are capable of producing substantial quantities of aerosol, both initially and over the useful life of the product without significant thermal degradation of the aerosol former and without the presence of substantial pyrolysis or incomplete combustion products or sidestream smoke. Moreover, they provide the user with the sensations of cigarette smoking without the necessity of burning tobacco.

In general, smoking articles which may employ impact modifying agents in accordance with the present invention include (1) a non-tobacco fuel element; (2) a physically separate aerosol generating means; and (3) an aerosol delivery means such as a longitudinal passageway in the form of a mouthend piece. Preferably, the smoking article is of the cigarette type, which utilizes a short, i.e., less than about 30 mm long, preferably carbonaceous, fuel element in conjunction with a physically separate aerosol generating means having one or more aerosol forming materials. This aerosol generating means is preferably in a conductive heat exchange relationship with the fuel element.

In general, the impact modifying agent in accordance with the present invention may be employed in any component of such articles which permits delivery of aerosol to the user including one or more of the above described components of such articles. Preferably, it is employed in the physically separate aerosol generating means.

As used herein the term "non-tobacco fuel element" is defined to include fuel elements which primarily contain non-tobacco combustible materials such as carbon. Such fuel elements may, however, include a minor amount of tobacco, tobacco extract, or a non-burning inert filler.

As used herein the term "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the term "carbonaceous" means primarily comprising carbon.

The preferred smoking articles of the present invention are described in greater detail in the accompanying drawing and in the detailed description of the invention which follow.

DETAILED DESCRIPTION OF THE PREFERRED EMBODIMENTS

Figure 1:
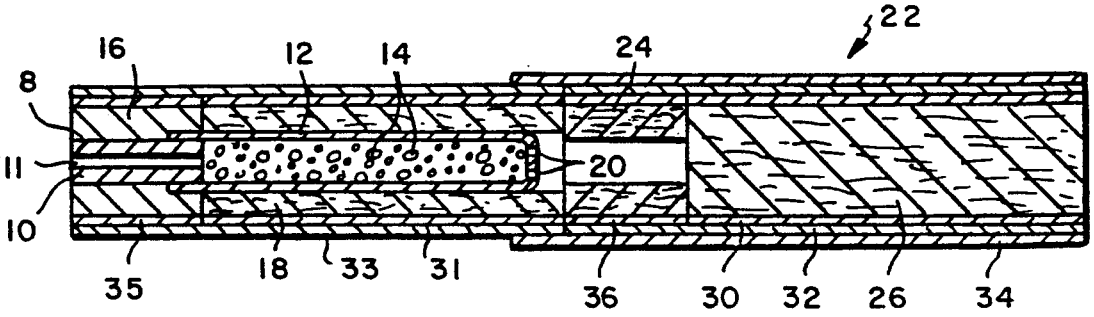
FIG. 1 is a longitudinal view of one preferred smoking article in accordance with present invention.

In accordance with the present invention, it has been discovered that the use of impact modifying agents, particularly carbohydrate ester acetates and carbohydrate ester levulinates and preferably levulinic acid and glucose pentaacetate in smoking articles, particularly in the aerosol generating means of such smoking articles, helps provide the user with the sensations of cigarette smoking by reducing the harshness of the aerosol produced and without causing irritation to the mouth, nose and throat.

While levulinic acid and glucose pentaacetate are the preferred impact modifying agents, other materials may also be employed to achieve the objects of the present invention. Specifically, other carbohydrate ester acetates such as sucrose octaacetate and fructose pentaacetate may be used in practicing the present invention. Similarly, as will be appreciated by those skilled in the art, carbohydrate ester levulinates may also be utilized.

The use of impact modifying agents such as levulinic acid and glucose pentaacetate are especially useful in smoking articles of the type described in the above mentioned EPO Patent Application, publication No. 174,645, particularly in those which employ tobacco or tobacco extracts, to simulate the taste of a conventional smoking product.

While not wishing to be bound by theory, it is believed that use of impact modifying agents such as levulinic acid and glucose pentaacetate in the preferred smoking articles of the present invention reduces the harshness of aerosol produced by the smoking article by modulating the pH of the substrate carrying the aerosol former, flavorants, etc., the aerosol produced by the smoking article, or both. Moreover, as noted above, it does so without the formation of undesirable side products or off-taste. The aerosol produced in articles employing an impact modifying agent in accordance with the present invention has been found to have a pH similar to that of smoke produced during smoking of conventional cigarettes. The resulting aerosol has been found to be more palatable in that it is less irritating to the mouth, nose and throat of the user. Thus, such articles possess an improved taste and provide enhanced smoking pleasure to the user.

In a preferred embodiment, the impact modifying agent of the present invention is employed in the aerosol generating means of the smoking article, and in particular, on the substrate material which serves as the carrier for the aerosol forming substance(s).

The amount of impact modifying agent by weight percent of the substrate employed in the aerosol generating means may range broadly, depending on several variables including the amount of nicotine or other flavorants delivered to the mainstream aerosol, the types of flavorants employed, i.e. flavorants which are basic may require additional amounts of impact modifying agent, the particular impact modifying agent employed as well as whether an impact modifying agent is employed in one or more of the other component parts of the smoking article.

Preferably, a functional amount of impact modifying agent is employed so as to modify the pH range of the aerosol generated during smoking to that of conventional cigarette smoke, i.e. preferably between about a pH of 4.0 and 7.5, most preferably between about 5.5 and 7.0, over 8 puffs, under FTC smoking conditions (35 ml puffs over a 2 second duration, separated by 58 seconds of smolder). The preferred protocol for determining the pH of such aerosols is described in A. J. Sensabaugh and R. H. Cundiff, Tobacco Science 11:25–30, 1967, the disclosure of which is incorporated herein by reference. In general, the amount of impact modifying agent by weight percent of the substrate bearing the aerosol former and/or flavor agents may range between about 0.01 and 8.0, preferably between 0.1 and 3.0, and most preferably between about 0.4 and 2.5.

The impact modifying agent of the present invention may be incorporated into the aerosol generating means in a variety of ways. For example, when the aerosol generating means comprises a substrate material as a carrier for the aerosol former, the impact modifying agent may be mixed with the aerosol forming material, added as a dust or a powder to the substrate, or it may be dissolved or dispersed in $H_2O$ or EtOH and thereafter applied to the substrate by spraying, dipping, etc. Other means of incorporating the impact modifying agents of the present invention into the aerosol generating means will be apparent to the skilled artisan.

While not preferred, the impact modifying agent may also be employed in one or more of the other components of the smoking article. The amount employed should again be sufficient so that the resultant mainstream aerosol produced approximates the pH of conventional cigarette smoke. Incorporation of the impact modifying agent into the fuel element, however, should be avoided to minimize production of undesirable side products.

Preferred smoking articles which may employ impact modifying agents in accordance with the present invention are described in the following patent applications:

| Applicants | Ser. No. | Filed |
|---|---|---|
| Sensabaugh et al. | 650,604 | September 14, 1984 |
| Shannon et al. | 684,537 | December 21, 1984 |
| Sensabaugh et al. | EPO 85111467.8 | September 11, 1985 (published 3/19/86) |

the disclosures of which are hereby incorporated by reference.

One such preferred cigarette-type smoking article is set forth in FIG. 1 accompanying this specification. Referring to FIG. 1 there is illustrated a cigarette-type smoking article having a small carbonaceous fuel element 10 with several passageways 11 therethrough, preferably about thirteen arranged as shown in FIG.

1A. This fuel element is formed from an extruded mixture of carbon (from carbonized paper), sodium carboxymethyl cellulose (SCMC) binder, $K_2CO_3$, and water, as described in the above referenced patent applications.

The periphery 8 of fuel element 10 is encircled by a resilient jacket of insulating fibers 16, such as glass fibers.

Overlapping a portion of the mouthend of the fuel element 10 is a metallic capsule 12 which contains an aerosol generating means including a substrate material 14 bearing one or more aerosol forming substances (e.g., polyhydric alcohols such as glycerin or propylene glycol) and an impact modifying agent such as levulinic acid or glucose pentaacetate.

Capsule 12 is circumscribed by a jacket of tobacco 18. Two slit-like passageways 20 are provided at the mouth end of the capsule in the center of the crimped tube.

At the mouth end of tobacco jacket 18 is a mouthend piece 22 comprising an annular section of cellulose acetate 24 and a segment of rolled, non-woven polypropylene scrim 26 through which the aerosol passes to the user. The article, or portions thereof, is overwrapped with one or more layers of cigarette papers 30–36.

Upon lighting the aforesaid embodiment, the fuel element burns, generating the heat used to volatilize the tobacco flavor material and any additional aerosol forming substance or substances in the aerosol generating means. Because the preferred fuel element is relatively short, the hot, burning fire cone is always close to the aerosol generating means which maximizes heat transfer to the aerosol generating means, and resultant production of aerosol, especially when the preferred heat conducting member is used.

Because of the small size and burning characteristics of the fuel element, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early and middle puffs. Because the preferred fuel element is so short, there is never a long section of nonburning fuel to act as a heat sink, as was common in previous thermal aerosol articles.

Because the aerosol forming substance in preferred embodiments is physically separate from the fuel element, the aerosol forming substance is exposed to substantially lower temperatures than are generated by the burning fuel, thereby minimizing the possibility of thermal degradation. Similarly, the lower temperatures employed to generate the aerosol significantly reduce the amount of undesirable side products associated with impact modifying agents employed to reduce the harshness of the aerosol produced.

In the preferred embodiments of the invention, the short carbonaceous fuel element, heat conducting member and insulating means cooperate with the aerosol generator to provide a system which is capable of producing substantial quantities of aerosol, on virtually every puff. The close proximity of the fire cone to the aerosol generator after a few puffs, together with the insulating means, results in high heat delivery both during puffing and during the relatively long period of smolder between puffs.

In general, the combustible fuel elements which are employed in practicing the invention have a diameter no larger than that of a conventional cigarette (i.e., less than or equal to 8 mm), and are generally less than about 20 mm long. Advantageously the fuel element is about 15 mm or less in length, preferably about 10 mm or less in length. Advantageously, the diameter of the fuel element is between about 2 to 8 mm, preferably about 4 to 6 mm. The density of the fuel elements employed herein has ranged from about 0.7 g/cc to about 1.5 g/cc. Preferably the density is greater than about 0.85 g/cc.

The preferred material used for the formation of fuel elements is carbon. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements, e.g., about 50 to 60% by weight, are within the scope of this invention, especially where a minor amount of tobacco, tobacco extract, or a nonburning inert filler is used. Preferred fuel elements are described in greater detail in the above referenced patent applications.

The aerosol generating means used in practicing this invention is physically separate from the fuel element. By physically separate is meant that the substrate, container, or chamber which contains the aerosol forming materials is not mixed with, or a part of, the fuel element. This arrangement helps reduce or eliminate thermal degradation of the aerosol forming substance and the presence of sidestream smoke. While not a part of the fuel element, the aerosol generating means preferably abuts, is connected to, or is otherwise adjacent to the fuel element so that the fuel and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The aerosol generating means is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors to satisfactorily resemble tobacco smoke.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., as well as SGL carbon, available from Calgon, Corp. Other suitable materials include inorganic solids, such as ceramics, glass, alumina, vermiculite, clays such as bentonite, or mixtures thereof. Carbon and alumina substrates are preferred.

An especially useful alumina substrate is a high surface area alumina (about 280 $m^2/g$), such as the grade available from the Davison Chemical Division of W. R. Grace & Co. under the designation SMR-14-1896. This alumina (−14 to +20 U.S. mesh) is preferably sintered for about one hour at an elevated temperature, e.g., greater than 1000° C., preferably from about 1400° to 1550° C., followed by appropriate washing and drying, prior to use.

It has been found that suitable particulate substrates also may be formed from carbon, tobacco, or mixtures of carbon and tobacco, into densified particles in a one-step process using a machine made by Fuji Paudal KK of Japan, and sold under the trade name of "Marumerizer." This apparatus is described in U.S. Pat. No. Re. 27,214.

The aerosol forming substance or substances used in the articles of the present invention must be capable of forming an aerosol at the temperatures present in the aerosol generating means upon heating by the burning fuel element. Such substances preferably are non-tobacco, non-aqueous aerosol forming substances and are composed of carbon, hydrogen and oxygen, but they may include other materials. Such substances can be in solid, semi-solid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono-, di-, or polycarboxylic acids, such as methyl stearate, dodecandioate, dimethyl tetradodecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed by any known technique on or within the substrate in a concentration sufficient to permeate or coat the material. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 140 mg, and preferably from about 40 mg to about 110 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generating means and the mouth end, such as in a separate substrate or chamber or coated within the passageway leading to the mouth end, or in the optional tobacco charge.

One particularly preferred aerosol generating means comprises the aforesaid alumina substrate containing spray dried tobacco extract, levulinic acid or glucose pentaacetate, one or more flavoring agents, and an aerosol former such as glycerin.

A charge of tobacco which also may include the impact modifying agent in accordance with the present invention may be employed downstream from the fuel element. In such cases, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

Articles of the type disclosed herein may be used or may be modified for use as drug delivery articles, for delivery of volatile pharmacologically or physiologically active materials such as ephedrine, metaproterenol, terbutaline, or the like.

The heat conducting member preferably employed in practicing this invention is typically a metallic tube or foil, such as deep drawn aluminum foil, varying in thickness from less than about 0.01 mm to about 0.1 mm, or more. The thickness and/or the type of conducting material may be varied (e.g., Grafoil, from Union Carbide) to achieve virtually any desired degree of heat transfer.

As illustrated in the embodiment in FIG. 1, the heat conducting member preferably contacts or overlaps the rear portion of the fuel element, and may form the container which encloses the aerosol forming substance. Preferably, the heat conducting member extends over no more than about one-half the length of the fuel element. More preferably, the heat conducting member overlaps or otherwise contacts no more than about the rear 5 mm, preferably 2–3 mm, of the fuel element. Preferred recessed members of this type do not interfere with the lighting or burning characteristics of the fuel element. Such members help to extinguish the fuel element when it has been consumed to the point of contact with the conducting member by acting as a heat sink. These members also do not protrude from the lighting end of the article even after the fuel element has been consumed.

The insulating members employed in practicing the invention are preferably formed into a resilient jacket from one or more layers of an insulating material. Advantageously, this jacket is at least about 0.5 mm thick, preferably at least about 1 mm thick, and preferably from about 1.5 to 2.0 mm thick. Preferably, the jacket extends over more than about half of the length of the fuel element. More preferably, it also extends over substantially the entire outer periphery of the fuel element and the capsule for the aerosol generating means. As shown in the embodiment of FIG. 1, different materials may be used to insulate these two components of the article.

Insulating members which may be used in accordance with the present invention generally comprise inorganic or organic fibers such as those made out of glass, alumina, silica, vitreous materials, mineral wool, carbons, silicons, boron, organic polymers, cellulosics, and the like, including mixtures of these materials. Nonfibrous insulating materials, such as silica aerogel, pearlite, glass, and the like may also be used. Preferred insulating members are resilient, to help simulate the feel of a conventional cigarette. Preferred insulating materials generally do not burn during use. However, slow burning materials and especially materials which fuse during heating, such as low temperature grades of glass fibers, may be used. These materials act primarily as an insulating jacket, retaining and directing a significant portion of the heat produced by the burning fuel element to the aerosol generating means. Because the insulating jacket becomes hot adjacent to the burning fuel element, to a limited extent, it also may conduct heat toward the aerosol generating means.

The currently preferred insulating fibers are ceramic fibers, such as glass fibers. Two preferred glass fibers are experimental materials produced by Owens-Corning of Toledo, Ohio under the designations 6432 and 6437. Other suitable glass fibers are available from the Manning Paper Company of Troy, N.Y., under the designations Manniglass 1000 and Manniglass 1200. When possible, glass fiber materials having a low softening point, e.g., below about 650° C., are preferred.

Several commercially available inorganic insulating fibers are prepared with a binder e.g., PVA, which acts to maintain structural integrity during handling. These binders, which would exhibit a harsh aroma upon heating, should be removed, e.g., by heating in air at about 650° C. for up to about 15 min. before use herein. If desired, pectin, at up to about 3 weight percent, may be added to the fibers to provide mechanical strength to the jacket without contributing harsh aromas.

In most embodiments of the invention, the fuel and aerosol generating means will be attached to a mouthend piece, although a mouthend piece may be provided separately, e.g., in the form of a cigarette holder for use with disposable fuel/aerosol generating cartridges. The mouth end piece channels the vaporized aerosol forming substance into the mouth of the user. Due to its length, about 35 to 50 mm, it also keeps the heat from the fire cone away from the mouth and fingers of the user, and provides some cooling of the hot aerosol before it reaches the user.

Suitable mouthend pieces should be inert with respect to the aerosol forming substances, should offer minimum aerosol loss by condensation or filtration, and should be capable of withstanding the temperature at the interface with the other elements of the article. Preferred mouthend pieces include the cellulose acetate polypropylene scrim combination of FIG. 1 and the mouthend pieces disclosed in Sensabaugh et al., European Patent Publication No. 174,645.

The entire length of the article or any portion thereof may be overwrapped with cigarette paper. Preferred papers at the fuel element end should not openly flame during burning of the fuel element. In addition, the paper should have controllable smolder properties and should produce a grey, cigarette-like ash.

In those embodiments utilizing an insulating jacket wherein the paper burns away from the jacketed fuel element, maximum heat transfer is achieved because air flow to the fuel element is not restricted. However, papers can be designed to remain wholly or partially intact upon exposure to heat from the burning fuel element. Such papers provide the opportunity to restrict air flow to the burning fuel element, thereby controlling the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., noncombustible mica paper with a plurality of holes therein, may be employed as the overwrap layer. Such a paper controls heat delivery, especially in the middle puffs i.e., 4–6).

To maximize aerosol delivery, which otherwise would be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 8-0560-36 Tipping with Lip Release paper, Ecusta's 646 Plug Wrap and ECUSTA 01788 manufactured by Ecusta of Pisgah Forest, N.C., and Kimberly-Clark's P868-16-2 and P878-63-5 papers.

The aerosol produced by the preferred articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31: 347–364 (1975); Nagao et al., *Mut. Res.*, 42: 335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

Smoking articles of the present invention which utilize impact modifying agents such as levulinic acid and glucose pentaacetate will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

EXAMPLE I

Smoking articles similar to FIG. 1 were made in the following manner.

A. Fuel Source Preparation

Grand Prairie Canadian (GPC) Kraft paper (non-talc grade) made from hardwood and obtained from Buckeye Cellulose Corp., Memphis, Tenn., was shredded and placed inside a 9" diameter, 9" deep stainless steel furnace. The furnace chamber was flushed with nitrogen, and the furnace temperature was raised to 200° C. and held for 2 hours. The temperature in the furnace was then increased at a rate of 5° C. per hour to 350° C. and was held at 350 ° C. for 2 hours. The temperature of the furnace was then increased at 5° C. per hour to 750° C. to further pyrolize the cellulose. Again the furnace was held at temperature for 2 hours to assure uniform heating of the carbon. The furnace was then cooled to room temperature and the carbon was ground into a fine powder (less than 400 mesh) using a "Trost" mill. This powdered carbon (CGPC) had a tapped density of 0.6 g/cc and hydrogen plus oxygen level of 4%.

Nine parts of this carbon powder was mixed with one part of SCMC powder, $K_2CO_3$ was added at 1 wt. percent, and water was added to make a thin slurry, which was then cast into a sheet and dried. The dried sheet was then reground into a fine powder and sufficient water was added to make a plastic mix which was stiff enough to hold its shape after extrusion, e.g., a ball of the mix will show only a slight tendency to flow in a one day period. This plastic mix was then loaded into a room temperature batch extruder. The female extrusion die for shaping the extrudate had tapered surfaces to facilitate smooth flow of the plastic mass. A low pressure (less than 5 tons per square inch or $7.03\times10^6$ kg per square meter) was applied to the plastic mass to force it through a female die of 4.6 mm diameter. The wet rod was then allowed to dry at room temperature overnight. To assure that it was completely dry it was then placed into an oven at 80° C. for two hours. This dried rod had a density of 0.85 g/cc, a diameter of 4.5 mm, and an out of roundness of approximately 3%.

The dry, extruded rod was cut into 10 mm lengths and seven 0.2 mm holes were drilled through the length of the rod in a closely spaced arrangement with a core diameter (i.e., the diameter of the smallest circle which will circumscribe the holes in the fuel element) of about 2.6 mm and spacing between the holes of about 0.3 mm.

B. Spray Dried Extract

Tobacco (Burley, Flue Cured, Turkish, etc.) was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C.

C. Substrate Preparation

High surface area alumina (surface area=280 $m^2/g$) from W. R. Grace & Co. (designated SMR-14-1896), having a mesh size of from −8 to +14 (U.S.) was sintered at a soak temperature of about 1400° C. for about one hour and cooled. The surface area of the modified alumina was approximately 4.0 $m^2/g$. The alumina was washed with water and dried. To the alumina (179 mg) there was added the following components: 29 mg spray dried tobacco; 40 mg glycerin; 32 mg triethylene glycol and 9 mg 1,3-butylene glycol; and 1.2 mg levulinic acid.

D. Aerosol Generator

The metallic containers for the substrate were 30 mm long spirally wound aluminum tubes obtained from Niemand, Inc., having a diameter of about 4.5 mm. Alternatively, a deep drawn capsule prepared from aluminum tubing about 4 mil thick (0.1016 mm), about 32 mm in length, having an outer diameter of about 4.5 mm may be used. One end of each of these tubes was crimped to seal the mouthend of the capsule. The sealed end of the capsule was provided with two slot-like openings (each about $0.65\times3.45$ mm, spaced about 1.14 mm apart) to allow passage of the aerosol former to the user. Approximately 170 mg of the modified alumina was used to fill each of the containers. After the metallic containers were filled, each was joined to a fuel element by inserting about 2 mm of the fuel element into the open end of the container.

E. Insulating Jacket

The fuel element—capsule combination was overwrapped at the fuel element end with a 10 mm long, glass fiber jacket of Owens-Corning 6437 (having a softening point of about 650° C.), with 4 wt. percent pectin binder, to a diameter of about 7.5 mm and overwrapped with P878-63-5 paper.

F. Tobacco Jacket

A 7.5 mm diameter tobacco rod (28 mm long) with a 646 plug wrap overwrap (e.g., from a non-filter cigarette) was modified with a probe to have a longitudinal passageway (about 4.5 mm diameter) therein.

G. Assembly

The jacketed fuel element—capsule combination was inserted into the tobacco rod passageway until the glass fiber jacket abutted the tobacco. The glass fiber and tobacco sections were overwrapped with Kimberly-Clark P878-16-2.

A cellulose acetate mouthend piece (30 mm long) overwrapped with 646 plug wrap, similar that illustrated in FIG. 1, was joined to a filter element (10 mm long) by RJR Archer Inc. 8--0560-36 tipping with lip release paper.

The combined mouthend piece section was joined to the jacketed fuel element—capsule section by a small section of white paper and glue.

Sensory evaluation of the above smoking article indicated that the article provided the user with a smooth smoke like effect in the throat and a pleasant tobacco-like aftertaste.

EXAMPLE II

Smoking articles were prepared substantially as in Example I except that 255 mg of a treated PG-60 granulated carbon was loaded into the capsule. The PG-60 was treated to make it suitable for use as the aerosol producing substrate by heating the material in a non-oxidizing atmosphere for about one hour at an elevated temperature, e.g., at about 2500° C., followed by appropriate washing and drying. The surface area of the treated carbon was less than about 200 $m^2/g$. The substrate material contained 11.3% by weight spray dried tobacco, 18.8% by weight glycerin and 1.5% by weight levulinc acid. A similar set of articles were prepared containing no impact modifying agent.

When the above articles were smoked under FTC conditions and compared with a conventional cigarette (Camel Lights), it was found that the pH of the mainstream aerosol produced by the article containing levulinic acid closely resembled the pH of the conventional cigarette i.e., between about 5.5 and 6.5. The articles which did not contain any impact modifying agent had a pH between about 5.5 and 8.5 over approximately 8 puffs. pH measurement were made as described in Sensabaugh and Cundiff, supra.

EXAMPLE III

Preferred cigarette-type smoking articles of the type substantially as illustrated in FIG. 1 are prepared in the following manner:

The fuel element (10 mm long, 4.5 mm o.d.) having an apparent (bulk) density of about 0.86 g/cc, was prepared from carbon (90 wt. percent), SCMC binder (10 wt. percent) and $K_2CO_3$ (1 wt. percent).

The carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated to a temperature of up to about 850° C. to remove volatiles.

After cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon : 1 part binder), 1 wt. percent $K_2CO_3$, and sufficient water to make a stiff, dough-like paste.

Figure 1A:
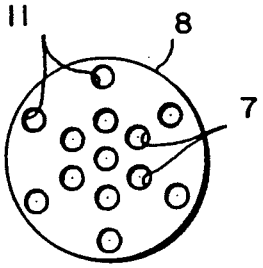
FIG. 1A illustrates, from the lighting end, a preferred fuel element passageway configuration having seven large central holes and 6 peripheral holes. The web thickness between the inner holes is about 0.0008 inches and the average outer web thickness is about 0.019 inches.

Fuel elements were extruded from this paste having seven large central holes each about 0.021 in. in diameter and six peripheral holes each about 0.01 in. in diameter as shown in FIG. 1A. The web thickness or spacing between the inner holes was about 0.008 in. and the average outer web thickness (the spacing between the periphery and holes) was 0.019 inc.

These fuel elements were then baked-out under a nitrogen atmosphere at 900° C. for three hours after formation.

The capsule used to construct the illustrated smoking article was prepared from deep drawn aluminum. The capsule had an average well thickness of about 0.004 in. (0.01 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user.

The substrate material for the aerosol generating means was W. R. Grace's SMR 14-896 high surface area alumina (surface area =280 $m^2/g$, having a mesh size of from −14, +20 (U.S.). Before use herein, this alumina was sintered for about 1 hour at a soak temperature which ranged from about 1400° to 1550° C. After cooling, this alumina was washed with water and dried.

This sintered alumina was combined, in a two-step method with the ingredients shown in Table I in the indicated proportions:

TABLE I

| | |
|---|---|
| Alumina | 67.7% |
| Glycerin | 19.0% |
| Spray Dried Extract | 8.5% |
| Flavoring Mixture | 4.2% |
| Glucose pentaacetate | 0.6% |

TABLE I-continued

| | |
|---|---|
| Total: | 100.0% |

The spray dried extract is the dry powder residue resulting from the evaporation of an aqueous tobacco extract solution. It contains water soluble tobacco components. The flavoring mixture is a mixture of flavor compounds which simulates the taste of cigarette smoke. One such material used herein was obtained from Firmenich of Geneva, Switzerland under the designation T69-22.

In the first step, the spray dried tobacco extract was mixed with sufficient water to form a slurry. This slurry was then applied to the alumina substrate by mixing until the slurry was uniformly absorbed by the alumina. The treated alumina was then dried to reduce the moisture content to about 1 wt. percent. In the second step, this treated alumina was mixed with a combination of the other listed ingredients until the liquid was uniformly absorbed within the alumina carrier. The capsule was filled with about 325 mg of this substrate material.

A fuel element prepared as above, was inserted into the open end of the filled capsule to a depth of about 3 mm. The fuel element—capsule combination was overwrapped at the fuel element end with a 10 mm long, glass fiber jacket of Owens-Corning 6437 (having a softening point of about 650° C.), with 4 wt. percent pectin binder, to a diameter of about 7.5 mm. The glass fiber jacket was then overwrapped with Kimberly-Clark's P878-63-5 paper.

A 7.5 mm diameter tobacco rod (28 mm long) with an overwrap of Ecusta 646 plug wrap was modified to have a longitudinal passageway (about 4.5 mm diameter) therein. The jacketed fuel element—capsule combination was inserted into the tobacco rod passageway until the glass fiber jacket abutted the tobacco. The jacketed sections were joined together by Kimberly-Clark's P850-208 paper (a process scale version of their P878-16-2paper).

A mouthend piece of the type illustrated in FIG. 1, was constructed by combining two sections; (1) a hollow cylinder of cellulose acetate (10 mm long/7.5 mm outer diameter/4.5 mm inner diameter) overwrapped with 646 plug wrap; and (2) a section of non-woven polypropylene scrim, rolled into a 30 mm long, 7.5 mm diameter cylinder overwrapped with Kimberly-Clark's P850-186-2 paper; with a combining overwrap of Kimberly-Clark's P850-186-2.

The combined mouthend piece section was joined to the jacketed fuel element—capsule section by a final overwrap of RJR Archer Inc. 8-0560-36 tipping with lip release paper.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:

(a) a carbonaceous fuel element;

(b) a physically separate non-burning charge of tobacco or tobacco extract; and (c) a physically separate aerosol generating means including an aerosol forming material, wherein the article includes in a non-burning portion thereof an impact modifying agent selected from the group of levulinic acid, a carbohydrate ester acetate, a carbohydrate ester levulinate, or mixtures thereof.

2. The smoking article of claim 1, wherein the agent is included in the aerosol generating means.

3. The smoking article of claim 1, wherein the carbohydrate ester acetate is selected from the group of glucose pentaacetate, sucrose octaacetate and fructose pentaacetate.

4. The smoking article of claim 3, wherein the agent is glucose pentaacetate.

5. The smoking article of claim 4, wherein the glucose pentaacetate is included in the aerosol generating means.

6. The smoking article of claim 1, wherein the agent is levulinic acid.

7. The smoking article of claim 6, wherein the levulinic acid is included in the aerosol generating means.

8. The smoking article of claim 1, 2, 3, 6 or 4, wherein the agent is incorporated in the article in an amount sufficient to provide a smoke pH between about 4.0 and 7.5.

9. The smoking article of claim 1, 2, 3, 6 or 4, wherein the agent is incorporated in the article in an amount sufficient to provide a smoke pH between about 5.5 and 7.0.

10. A smoking article comprising:

(a) a carbonaceous fuel element;

(b) a physically separate non-burning charge of tobacco or tobacco extract; and (c) a physically separate aerosol generating including a substrate bearing an aerosol forming material, the substrate being selected from carbon or alumina, wherein the article includes in a non-burning portion thereof an agent selected from the group of levulinic acid, a carbohydrate ester acetate, a carbohydrate ester levulinate, or mixtures thereof.

11. The smoking article of claim 10, wherein the agent is carried by the substrate and the amount of agent employed by weight percent of the aerosol bearing substrate is in the range between about 0.01 and about 8.0.

12. The smoking article of claim 10, wherein the agent is carried by the substrate and the amount of agent employed by weight percent of the aerosol bearing substrate is in the range between about 0.1 and about 3.0.

13. The smoking article of claim 10, wherein the agent is carried by the substrate and the amount of agent employed by weight percent of the aerosol bearing substrate is in the range between about 0.4 and about 2.5.

14. The smoking article of claim 1 or 10, wherein the agent is mixed with the charge of tobacco or tobacco extract.

15. The smoking article of claim 1 or 10, wherein the aerosol generating means includes a charge of tobacco or tobacco extract.

* * * * *